US006763549B1

(12) United States Patent
Peters

(10) Patent No.: US 6,763,549 B1
(45) Date of Patent: Jul. 20, 2004

(54) EDGE CLEANING VACUUM CLEANER APPARATUS

(76) Inventor: Rudolph W. Peters, 5786 Balmoral Dr., Oakland, CA (US) 94619

( * ) Notice: Subject to any disclaimer, the term of this patent is extended or adjusted under 35 U.S.C. 154(b) by 408 days.

(21) Appl. No.: 09/947,277

(22) Filed: Sep. 7, 2001

(51) Int. Cl.[7] ..... A47L 9/04

(52) U.S. Cl. ..... 15/374; 15/377; 15/383; 15/415.1

(58) Field of Search ..... 15/344, 374, 377, 15/383, 415.1

(56) References Cited

U.S. PATENT DOCUMENTS 3,319,278 A * 5/1967 Frazer ..... 15/374
3,936,903 A 2/1976 Johnson
3,959,847 A 6/1976 Kaulig et al.
4,219,902 A 9/1980 DeMaagd
4,355,436 A 10/1982 Hertzberg
4,606,092 A * 8/1986 Henning ..... 15/374
4,638,527 A 1/1987 Fleischhauer
4,653,137 A 3/1987 Fleischhauer
4,928,346 A * 5/1990 Elson et al. ..... 15/377
5,115,538 A 5/1992 Cochran et al.
5,347,679 A 9/1994 Saunders et al.
5,440,782 A 8/1995 Yamashita
6,381,805 B1 * 5/2002 Martin ..... 15/415.1
6,430,773 B1 * 8/2002 Buron et al. ..... 15/374
6,481,043 B1 * 11/2002 Anderson et al. ..... 15/344
6,536,076 B2 * 3/2003 Scian et al. ..... 15/415.1

* cited by examiner

*Primary Examiner*—Theresa T. Snider
(74) *Attorney, Agent, or Firm*—Harris Zimmerman

(57) ABSTRACT

Vacuum cleaning apparatus having a rotary brush situated at an air intake opening in a housing has a configuration which enables efficient cleaning of edge portions of a floor that are adjacent to a wall or other vertical surface. A cleaning head portion of the housing has intersecting sidewalls which extend at right angles to each other enabling one sidewall to face the edge of a floor while the other sidewall faces the lower edge of an adjacent wall. The air intake opening is angled to extend into both of the angled intersecting sidewalls of the cleaning head. The rotary brush carries bristles which protrude through the air intake opening at both of the sidewalls of the cleaning head and at the intersection between the sidewalls.

14 Claims, 4 Drawing Sheets

FIG. 1
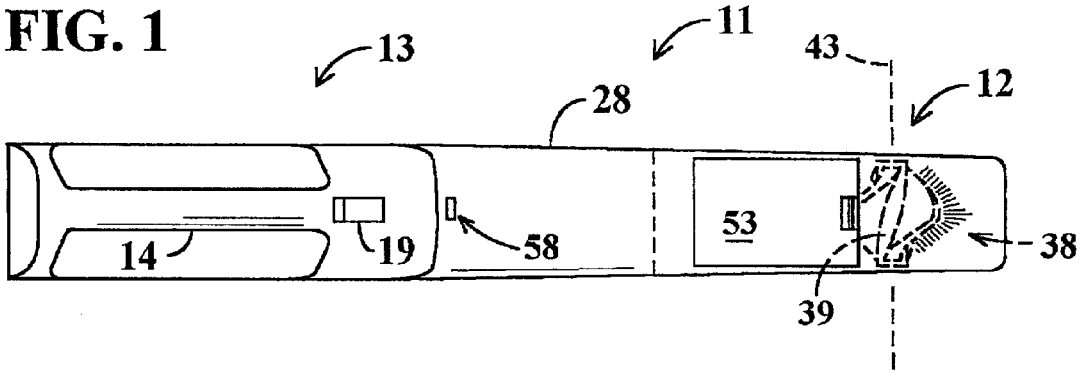
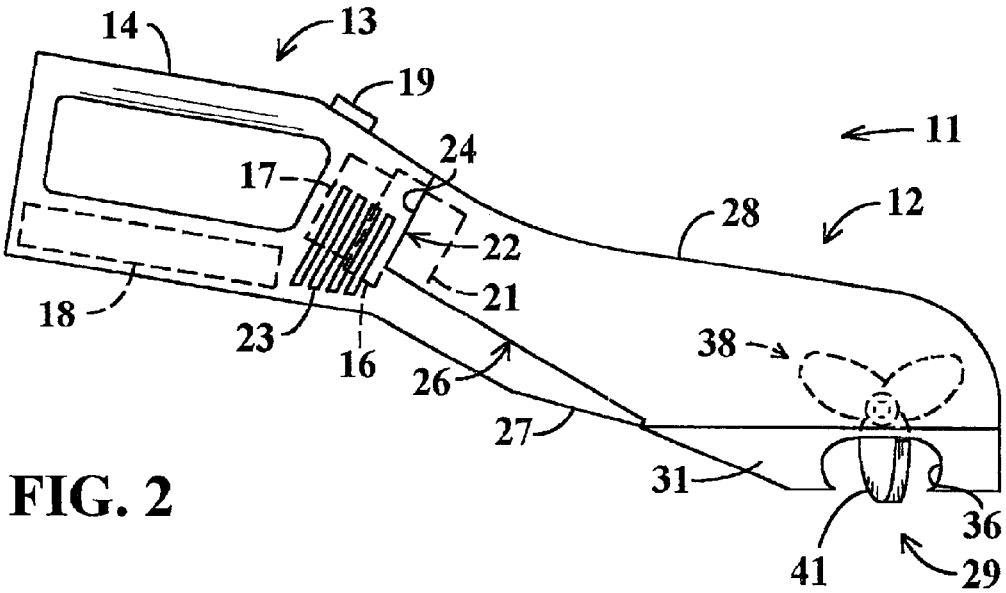
FIG. 2

EDGE CLEANING VACUUM CLEANER APPARATUS

BACKGROUND OF THE INVENTION

This invention relates to vacuum cleaning apparatus for cleaning floors or other surfaces. More particularly the invention relates to vacuum cleaning apparatus for cleaning edge regions of floors that are adjacent to walls or other vertically extending surfaces.

Vacuum cleaners have a motor driven rotary fan which draws air into an intake opening in a housing to create suction which draws dust and other loose material into the housing. The cleaning effect is enhanced if a rotating brush is present at the air intake opening. The brush loosens dust or other material that may tend to cling to the floor or to carpets or rugs which are present on the floor.

The air intake openings of commercially available vacuum cleaners which have a rotary brush do not extend all of the way to the side surfaces nor to the front surface of the vacuum cleaner housing. Portions of the housing bound the intake opening at the sides and at the front of the opening in order to define the air flow path and to channel the air flow towards the brush. Space adjacent to the ends of the intake opening is occupied by bearings for supporting the rotary brush. As a result, the air intake opening cannot be positioned directly over the extreme edge regions of the floor where the floor contacts a wall or other vertical surface. A rotary brush which is situated within the air intake opening cannot be abutted directly against the wall. Consequently, the standard vacuum cleaner does not clean the extreme edges of a floor in an efficient manner at locations where the floor meets a wall or other vertical surface.

In some instances, the problem is addressed by providing an air intake accessory which attaches to a flexible vacuum hose that bypasses the main air intake opening and rotary brush. This cleans the edge regions by suction only. Suction alone does not clean as effectively as suction combined with a brushing action. Some prior vacuum cleaner designs have supplemental brushes at the sides of the vacuum cleaner housing or brushes with angled bristles at the ends which extend away from the air intake opening towards the sides of the housing. Supplemental brushes or angled bristles of this kind are not directly within the air intake opening of the vacuum cleaner and are at a location where the suction effect is diminished or absent. Brushing in the absence of a strong suction air flow does not provide the most effective cleaning.

The present invention is directed to overcoming one or more of the problems discussed above.

BRIEF SUMMARY OF THE INVENTION

In one aspect the present invention provides vacuum cleaning apparatus having a housing at which an air intake opening is situated and having a rotary brush disposed at the opening. The housing has intersecting first and second sidewalls which extend substantially at right angles to each other enabling one of the sidewalls to face a horizontally extending edge of a floor while the other sidewall faces a lower portion of a vertically extending wall. The air intake opening has first and second adjoining portions which extend substantially at right angles to each other, the first portion of the air intake opening being in the first sidewall of the housing and the second portion of the air intake opening being in the second sidewall of said housing. The rotary brush has bristles which protrude through the first portion of the air intake opening and also bristles which protrude through the second portion thereof.

In another aspect of the invention, vacuum cleaning apparatus includes a housing having an air intake region with intersecting first and second sidewalls that extend at right angles to each other enabling the air intake region to be fitted against an edge of a floor that is adjacent to a vertical wall. The air intake region of the housing has a right angled air intake opening situated at the intersecting first and second sidewalls and which extends across the intersection thereof. A rotary brush is disposed in the housing adjacent to the air intake opening and has bristles which protrude through the air intake opening at each of the first and second sidewalls and at the intersection thereof.

The invention enables efficient vacuum cleaning of the margins of a floor which are adjacent to a wall or other vertical surface. The vacuum cleaning apparatus has an air intake structure and a rotary brush which are configured to fit into the right angled junction of the floor and vertical wall. The air intake opening is angled to extend horizontally across the edge region of the floor and then upward along a lower edge of the wall. The rotary brush at the air intake opening has sides which are angled relative to each other enabling bristle contact with the edge region of the floor and also with the lower edge of the wall.

The invention, together with further objects and advantages thereof, may be further understood by reference to the following detailed description of the invention and by reference to the accompanying drawings.

BRIEF DESCRIPTION OF THE DRAWINGS

FIG. 1 is a top view of a hand held vacuum cleaning apparatus in accordance with a preferred embodiment of the invention.

FIG. 2 is a side view of the vacuum cleaning apparatus of FIG. 1.

DETAILED DESCRIPTION OF THE INVENTION

Figure 3:
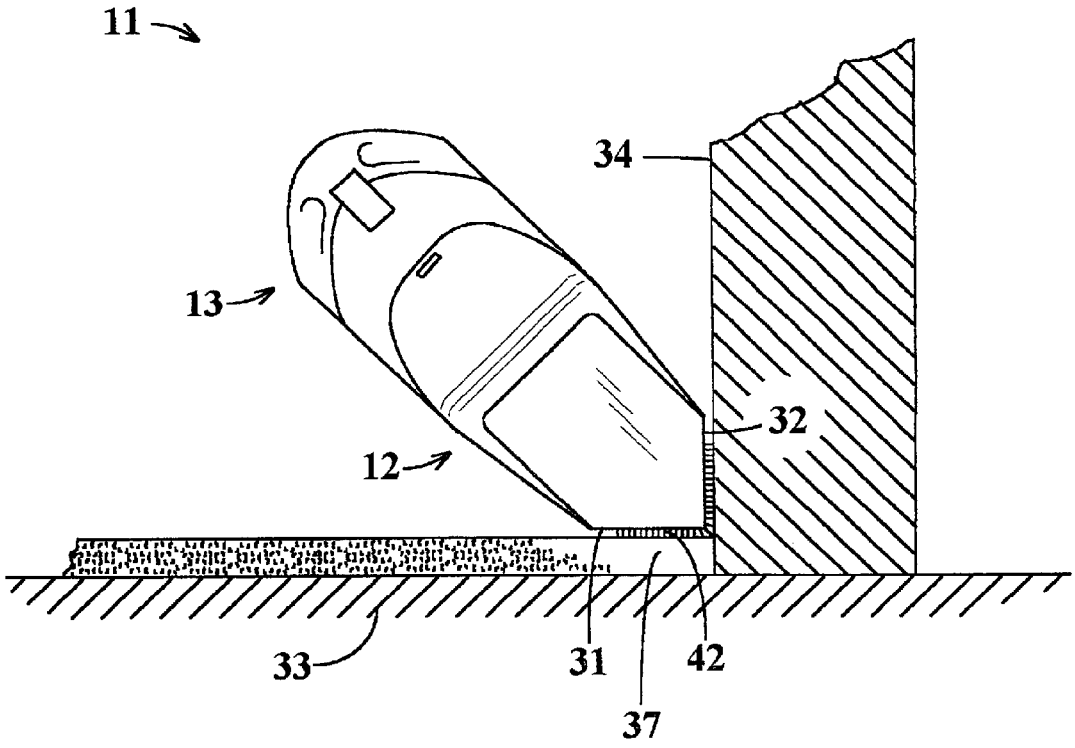
FIG. 3 is a front view of the vacuum cleaning apparatus of the preceding figures depicting use of the device for cleaning an edge region of a floor.

Referring initially to FIGS. 1 and 2 of the drawings, the vacuum cleaning apparatus 11 of this particular example of the invention includes an edge cleaning head 12 which attaches to a portable hand held vacuum cleaner body 13.

Vacuum cleaner body 13 may be of any of the known commercially available designs which have a handle 14 that is grasped by the user and which contain a suction generating air pump that is typically a rotary fan 16 driven by an electrical motor 17. Motor 17 is powered by a battery 18 which is of the rechargeable type in this example. A switch 19 at the exterior surface of the vacuum cleaner body 13 enables the apparatus to be turned on and off.

Fan 16 draws air into the vacuum cleaner body 13 through a replaceable porous filter 21 situated at a forward face 22 of the cleaner body 13 and the air is exhausted through vents 23 in the side walls of the cleaner body. The back end 24 of the edge cleaning head 12 accessory seats against the forward face 22 of the cleaner body 13 and a back portion 26 of the underside of the cleaning head seats against a shelf 27 that extends outward at the base of face 22 of the cleaner body 13. Thus operation of the fan 16 creates an inflow of air into cleaning head 12.

Cleaning head 12 has a housing 28 which extends forward from cleaner body face 22 along shelf 27 to an air intake region 29 of the cleaning head which is in front of the shelf. Referring jointly to FIGS. 2 and 3, the underside of housing 28 at region 29 has first and second convergent intersecting sidewalls 31 and 32 respectively which extend substantially at right angles to each other. This configuration enables one of the sidewalls 31 or 32 to face an edge of a horizontally extending floor 33 while the other sidewall faces an adjacent vertically extending wall 34. An angled air intake opening 36 has a first portion situated in the first sidewall 31 of the housing and a second portion situated in the second sidewall 32 and extends across the intersection of the two faces. Thus the cleaning head 12 configuration enables direct air suction to be applied to the edges of carpets 37 or the like.

The cleaning head 12 configuration also enables rotary brushing of the carpet 37 edge and a lower portion of wall 34 at air intake opening 36 thereby greatly enhancing the cleaning effect. Referring again to FIGS. 1 and 2, a rotary brush 38 is disposed within the air intake region 29 of housing 28 and is rotatable about an axis of rotation 43 which extends at a 45° angle when one of the housing sidewalls 31 and 32 is in a horizontal orientation and the other is vertical. Brush 38 has side surfaces 39 which face the angled air intake opening 36 as rotation of the brush travels the side surfaces along the opening. Bands 41 of brush bristles 42 protrude from the side surfaces 39 of brush 38. The bristle bands 41 extend from the periphery of the rotary brush 38 towards the axis of rotation 43 of the brush and the bristles 42 are proportioned to protrude though the air intake opening 36 of housing 28 as they sweep along the opening as may be seen in FIG. 3. The bristle bands 41 have a spiraled configuration relative to rotary axis 43 in this example of the invention.

Figure 4:
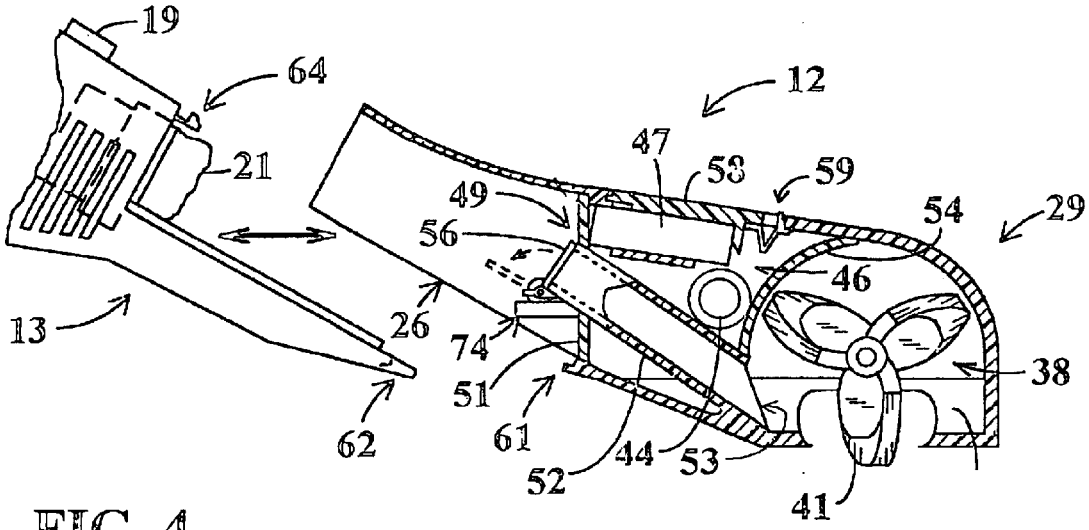
FIG. 4 is a side view of the vacuum cleaning apparatus of the preceding figures showing a detachable cleaning head portion of the apparatus separated from the vacuum cleaner body and showing the detachable cleaning head in section view.
Figure 5:
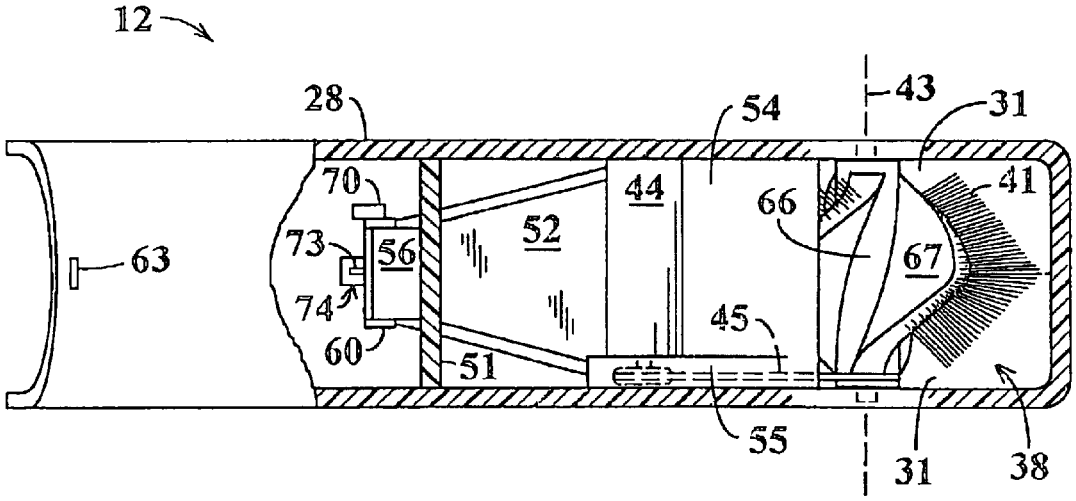
FIG. 5 is a broken out top view of the detachable cleaning head portion of the apparatus of the preceding figures.

Referring jointly to FIGS. 4 and 5, rotary brush 38 is driven by an electrical motor 44 disposed in a motor compartment region 46 of housing 28. A drive belt 45 operatively couples the motor 44 to brush 38. Motor 44 is energized by a replaceable battery 47 which is situated in the motor compartment 46 and which is electrically connected to the motor through an on-off switch in a manner which causes the motor to be turned on in response to airflow through the apparatus as will hereinafter be described in more detail.

Internal partitioning 49 compartmentalizes the interior of housing 28 and defines the air flow path through the housing. Partitioning 49 includes a transversely extending wall 51 which separates the air intake region 29 of the housing 28 from the back portion 26 of the housing where dust is collected. A tapered hollow airflow channeling member 52 extends through the wall 51. Channeling member 52 has a broad base 53 which spans the bottom of housing 28 at a location which is below motor compartment 46. A curved wall 54 extends from the base of channeling member 52 to the top of housing 28 to isolate motor compartment 46 from the air flow path through the housing. An inverted channel shaped partitioning member 55 extends backward from the curved wall 54 and encloses the motor drive belt 45 to prevent air flow into the motor compartment 46 at the location of the belt.

Figure 6:
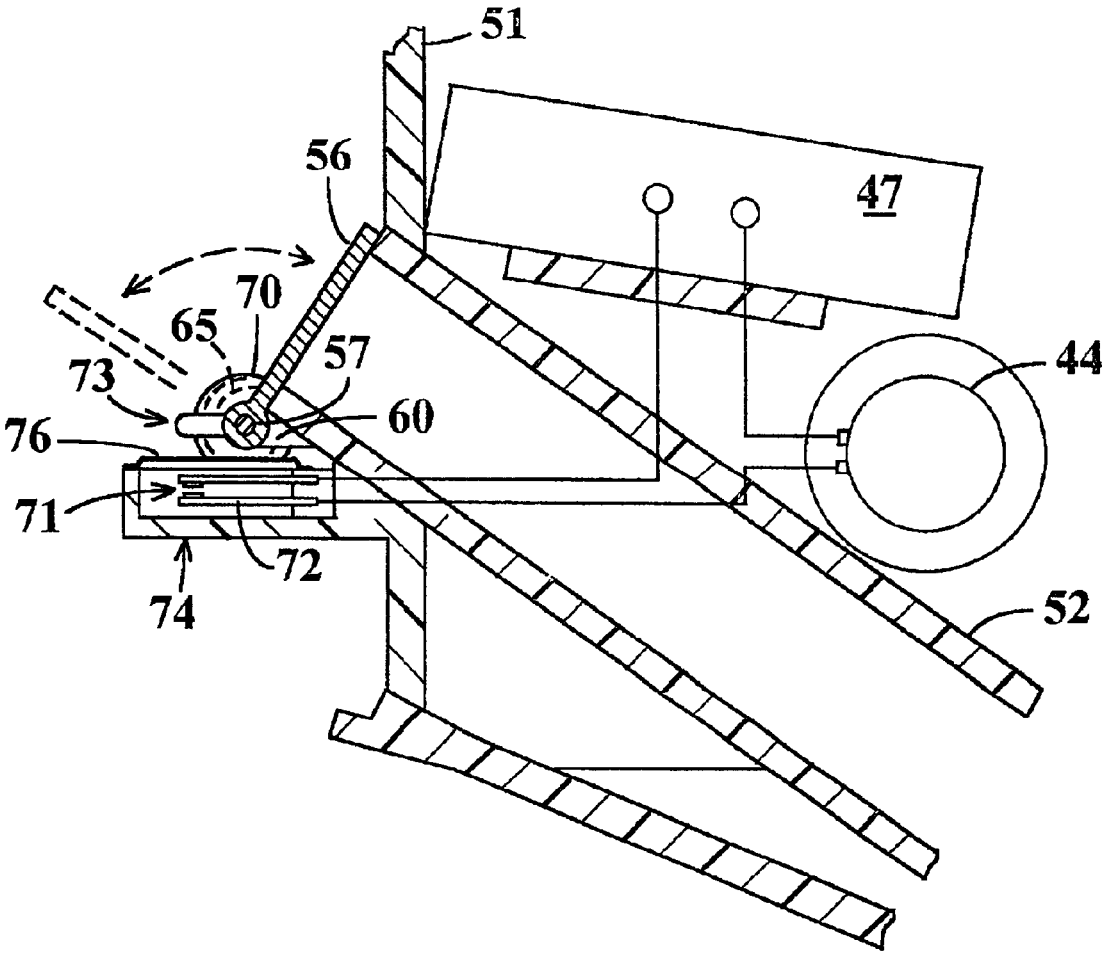
FIG. 6 is a section view depicting a portion of the interior region of the detachable cleaning head portion on a larger scale than FIG. 4 and showing switch structure which actuates the cleaning head in response to air flow into the cleaning head.

A pivotable gate flap 56 seats against the end of channeling member 52 that opens into the back portion of housing 28. Flap 56 blocks the flow path of channeling member 52 when the cleaning apparatus is turned off to prevent loss of dust which has been collected within the back end of housing 28. Referring to FIG. 6 in conjunction with FIGS. 4 and 5, flap 56 has a pivot axle 57 which extends into tabs 60 formed on the channeling member 52 and a spiral leaf spring 65 situated in a housing 70 which is attached to the channeling member exerts a torque force on the axle which acts to seat the flap against the channeling member. The flap 56 is pivoted to open the channeling member 52 by the incoming air flow when the apparatus is turned on.

Referring again to FIGS. 4 and 5, the top of housing 28 has a removable door 58, held in place by a resilient latch 59, which provides for access to the motor compartment 44 of the housing. The rear portion of housing 28 is adapted for engagement with the cleaning head engagement arrangements of the particular type of vacuum cleaner body 13 with which it is to be used. Different commercially available cleaner bodies 13 may have differing arrangements of this kind. In this particular example, a projecting tab 61 is provided at the underside of housing 28 in position to seat in a stepped notch 62 which is present at the end of shelf 27 of cleaner body 13. A small opening 63 at the top of the back end of housing 28 receives a depressable cleaning head latching tang 64 that extends from the top of the back face 22 of the cleaner body 13.

The rotary brush 38 may have other shapes but is preferably of the form shown in FIGS. 4 and 5 as it provides for an efficient direct sweeping of the extreme edge regions of a floor. The brush 38 has a cylindrical axle portion 66 aligned along axis of rotation 43 and from which blades 67 extend outward at angular intervals around the axis of rotation. Blades 67 have a spiraling curvature relative to the axle portion 66 of the brush 38. Bristles 41 protrude from side surfaces 39 of the blades 67 which surfaces are oriented to be substantially parallel to the intersecting sidewalls 31 of housing 28 as they sweep along the air intake opening 36 at the sidewalls.

Cleaning head 12 can be provided with a manually operated on-off switch for actuating motor 44 but preferably the motor is turned on and off automatically in response to manual operation of the control switch 19 of the vacuum cleaner body 13. For this purpose, with reference again to FIG. 6, battery 47 is connected to motor 44 through a pair of switch contacts 71 which are carried by resilient arms 72 that hold the contacts in a normally open condition when there is no airflow through the apparatus. Contacts 71 are situated below gate flap 56 and a tang 73 which extends from the flap depresses the contacts to close the switch and activate motor 44 when the flap is pivoted to the open condition by airflow through channeling member 52. Contacts 71 are encased in a housing 74 which extends from housing partition 51, the housing being sealed at the top by a cover 76. Cover 76 is formed of flexible material to enable tang 73 to enter the housing. The sealing cover 76 protects contacts 71 from dust and debris.

The invention has been herein described with reference to a hand held portable vacuum cleaner. The edge cleaning head can be adapted to other forms of vacuum cleaner such as upright vacuum cleaners and canister vacuum cleaners which are often provided with a flexible tube to which optional cleaning head accessories can be fastened.

While the invention has been described with reference to a particular embodiment for purposes of example, many modifications and variations are possible and it is not intended to limit the invention except as defined by the following claims.

What is claimed is:

1. Vacuum cleaning apparatus having a housing at which an air intake opening is situated and having a rotary brush disposed at said opening, wherein the improvement comprises:

said housing having intersecting first and second sidewalls which extend substantially at right angles to each other enabling one of said sidewalls to face a horizontally extending edge of a floor while the other of said sidewalls faces a lower portion of an adjacent vertically extending wall, said air intake opening having first and second adjoining portions which extend substantially at right angles to each other, the first portion of said air intake opening being in said first sidewall of said housing and the second portion of said air intake opening being in said second sidewall of said housing, said rotary brush having bristles which protrude through said first portion of said air intake opening and also bristles which protrude through said second portion thereof.

2. The vacuum cleaning apparatus of claim 1 wherein said rotary brush has opposite side surfaces facing said first and second portions of said air intake opening and from which said bristles protrude, said bristles being situated in bands which extend from the periphery of said brush towards the axis of rotation thereof.

3. The vacuum cleaning apparatus of claim 1 wherein said rotary brush is supported for rotation about an axis of rotation that extends substantially at a forty five degree angle to horizontal when one of said housing sidewalls is disposed against said horizontally extending edge of the floor and the other of said housing sidewalls extends vertically.

4. The vacuum cleaning apparatus of claim 3 wherein said rotary brush has a plurality of blades situated at angular intervals around said axis of rotation, wherein said bristles protrude from side surfaces of said blades that face said first and second sidewalls of said housing.

5. The vacuum cleaning apparatus of claim 1 wherein bristles which protrude through said first portion of said air intake opening and bristles which protrude through said second portion of said air intake opening adjoin each other at the intersection of said first and second sidewalls of said housing.

6. The vacuum cleaning apparatus of claim 1 wherein said housing defines an airflow path which extends into said air intake opening at the location of said rotary brush, further including an electrical motor disposed in a motor compartment in said housing and being operatively coupled to said rotary brush, said housing having internal partitioning configured to isolate said motor compartment from said airflow path.

7. The vacuum cleaning apparatus of claim 1 wherein said sidewalls of said housing intersect at a line of intersection which extends in orthogonal relationship with the axis of rotation of said rotary brush and wherein a back end of said housing extends away from said rotary brush in a direction which is angled relative to said line of intersection.

8. The vacuum cleaning apparatus of claim 1 wherein said housing and rotary brush are components of a detachable cleaning head for a portable vacuum cleaning having a body which contains a motor driven fan creating an inflow of air into the body, said housing being configured for attachment to said body at a location thereon wherein said inflow of air is drawn through said housing including said air intake opening thereof.

9. The vacuum cleaning apparatus of claim 8 wherein said portable vacuum cleaner contains a first motor which drives said fan to create said inflow of air into said body and wherein said cleaning head contains a second motor which drives said rotary brush.

10. The vacuum cleaning apparatus of claim 9 wherein said cleaning head further includes an electrical battery and an electrical switch connected between said battery and said second motor, further including a movable switch actuator positioned to close said switch and actuate said second motor in response to said inflow of air.

11. The vacuum cleaning apparatus of claim 10 wherein said cleaning head includes an airflow channeling member through which said inflow of air flows to said body, further including a deflectable gate flap which blocks said air channeling member in the absence of said inflow of air, said switch actuator being movable to close said electrical switch in response to deflection of said gate flap by said inflow of air.

12. Vacuum cleaning apparatus comprising a housing having an air intake region with intersecting first and second sidewalls that extend at right angles to each other enabling the air intake region to be fitted against an edge of a floor that is adjacent to a vertical wall, said air intake region of said housing having a right angled air intake opening situated at said intersecting first and second sidewalls and which extends across the intersection thereof, and a rotary brush disposed in said housing adjacent to said air intake opening, said rotary brush having bristles which protrude through said air intake opening at each of said first and second sidewalls and at the intersection thereof.

13. The vacuum cleaning apparatus of claim 12 wherein said housing extends from a portable vacuum cleaner body having a motor driven fan which draws air through said housing including said air intake opening thereof.

14. The vacuum cleaning apparatus of claim 13 wherein said housing is disengageable from said portable cleaner body and is re-engageable thereon.

* * * * *